US006216627B1

(12) United States Patent
Johnsen et al.

(10) Patent No.: US 6,216,627 B1
(45) Date of Patent: Apr. 17, 2001

(54) SEISMIC SURVEY VESSELS

(75) Inventors: Baard Johnsen, Lillesand; Oyvind Aanonsen, Mandal, both of (NO); Mark Richard Williamson, Sugar Land, TX (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 09/445,625

(22) PCT Filed: Jun. 23, 1998

(86) PCT No.: PCT/GB98/01832

§ 371 Date: Dec. 9, 1999

§ 102(e) Date: Dec. 9, 1999

(87) PCT Pub. No.: WO99/00295

PCT Pub. Date: Jan. 7, 1999

(30) Foreign Application Priority Data

Jun. 27, 1997 (GB) ..... 9713660
Jun. 12, 1998 (GB) ..... 9812817

(51) Int. Cl.[7] ..... B63B 21/26

(52) U.S. Cl. ..... 114/244; 114/254

(58) Field of Search ..... 114/242, 244, 114/243, 245, 253, 254; 367/15–24

(56) References Cited

U.S. PATENT DOCUMENTS 4,313,392 * 2/1982 Guenther et al. ..... 114/244

FOREIGN PATENT DOCUMENTS

245957 * 11/1987 (EP) .

* cited by examiner

*Primary Examiner*—Ed Swinehart
(74) *Attorney, Agent, or Firm*—John H Bouchard

(57) ABSTRACT

A seismic survey vessel having a displacement monohull is provided with a streamer deck which width increases progressively from amidships towards the stern of the vessel, on both sides of the centerline of the vessel. This increased width of the streamer deck, reaching 37.5 meters at the stern, facilitates the deployment and towing of particularly wide streamer arrays, containing as many as sixteen streamers. It also provides space for the installation of novel streamer handling systems, one for each streamer, across the width of the rear of the streamer deck.

18 Claims, 5 Drawing Sheets

SEISMIC SURVEY VESSELS

BACKGROUND OF THE INVENTION

This invention relates to seismic survey vessels, and is more particularly concerned with seismic survey vessels suitable for use in performing 3D marine seismic surveys covering large areas.

In order to perform a 3D marine seismic survey, a plurality of seismic streamers, each typically several thousand meters long and containing arrays of hydrophones and associated electronic equipment distributed along its length, are towed at about 5 knots behind a seismic survey vessel, which also tows one or more seismic sources, typically air guns. Acoustic signals produced by the seismic sources are directed down through the water into the earth beneath, where they are reflected from the various strata. The reflected signals are received by the hydrophones in the streamers, digitised and then transmitted to the seismic survey vessel, where they are recorded and at least partially processed with the ultimate aim of building up a representation of the earth strata in the area being surveyed.

At the present time, a typical streamer array used by the Applicant comprises a 700 meter wide array of eight evenly spaced streamers, each about 4000 meters long. The streamers are towed by their lead-ins, ie the armoured electrical cables that convey electrical power, control and data signals between the vessel and the streamers, as described in the Applicant's U.S. Pat. No. 4,798,156, and their spread is controlled and maintained by MONOWING deflectors of the kind described in the Applicant's U.S. Pat. No. 5,357,892.

An array of this relatively large size allows 3D seismic surveys of large areas to be performed very efficiently. However, because the cost of performing such surveys is so high, there is continuous pressure to improve efficiency still further.

SUMMARY OF THE INVENTION

One way of achieving this is to use even wider streamer arrays, containing even.

According to the present invention, therefore, there is provided a seismic survey vessel having a displacement monohull, and powered drum means and cooperating guide means for deploying and recovering seismic streamers over the stern of the vessel via a streamer deck disposed at a substantial height above the waterline of the vessel, wherein the drum means are mounted substantially amidships in the vessel, the streamer deck at the stern of the vessel projects laterally outwardly from the hull of the vessel on both sides of the centre line of the vessel and is wider than the remainder of the vessel, and the guide means includes guide devices distributed across substantially the whole width of the streamer deck to facilitate the lateral spreading of the streamers.

In a preferred embodiment of the invention, the streamer deck of the vessel is an upper deck (although not necessarily the uppermost deck), at a height such that when the vessel is normally docked, the deck is well above the dock.

Preferably the width of the streamer deck decreases progressively from the stern of the vessel until it becomes substantially equal to the width of the vessel amidships.

Advantageously, at least parts of the drum means are mounted in the vessel at a level lower than the streamer deck.

The vessel preferably includes a further deck below the streamer deck at the stern of the vessel, said further deck being provided with means for deploying and recovering seismic source means over the stern of the vessel.

In a particularly advantageous implementation of the invention, the guide means comprises a respective streamer handling apparatus associated with each of a plurality of the streamers, each such apparatus comprising:

a beam;

means for mounting the beam above normal head height above the streamer deck of the vessel, such that the beam extends generally longitudinally of the vessel, the mounting means including a pivotal connection to the sternmost end of the beam permitting said end to pivot about a horizontal axis extending generally transversely of the beam, and support means for lowering and raising the other end of the beam towards and away from the streamer deck; and a respective one of said guide devices, each such guide device comprising pulley means secured to and movable along the beam.

Advantageously, the mounting means is secured to the underside of a further deck of the vessel, above the streamer deck.

Conveniently, the pulley means comprises carriage means movable along the beam, a pulley device, and means for suspending the pulley device beneath the carriage means.

Preferably, the suspension means comprises a collar which is rotatably supported on the carriage means and which is rotatable about the longitudinal axis of the beam.

Additionally, the pulley device is preferably pivotable about a horizontal axis which extends generally transversely of the beam.

The carriage means preferably includes at least one hydraulic motor arranged to move it in both directions along the beam, and is advantageously provided with hoisting means at its sternmost end.

Conveniently, the support means comprises a telescopic member which is pivotally connected at one end to the mounting means and at the other end to said other end of the beam, and is hydraulically operated.

The apparatus may further comprise downwardly projecting guidance means which is positioned at said other end of the beam and which engages and pushes down the streamer when said other end of the beam is lowered.

BRIEF DESCRIPTION OF THE DRAWINGS

The invention will now be described, by way of example only, with reference to the accompanying drawings, of which.

DESCRIPTION OF THE PREFERRED EMBODIMENT

Figure 1:
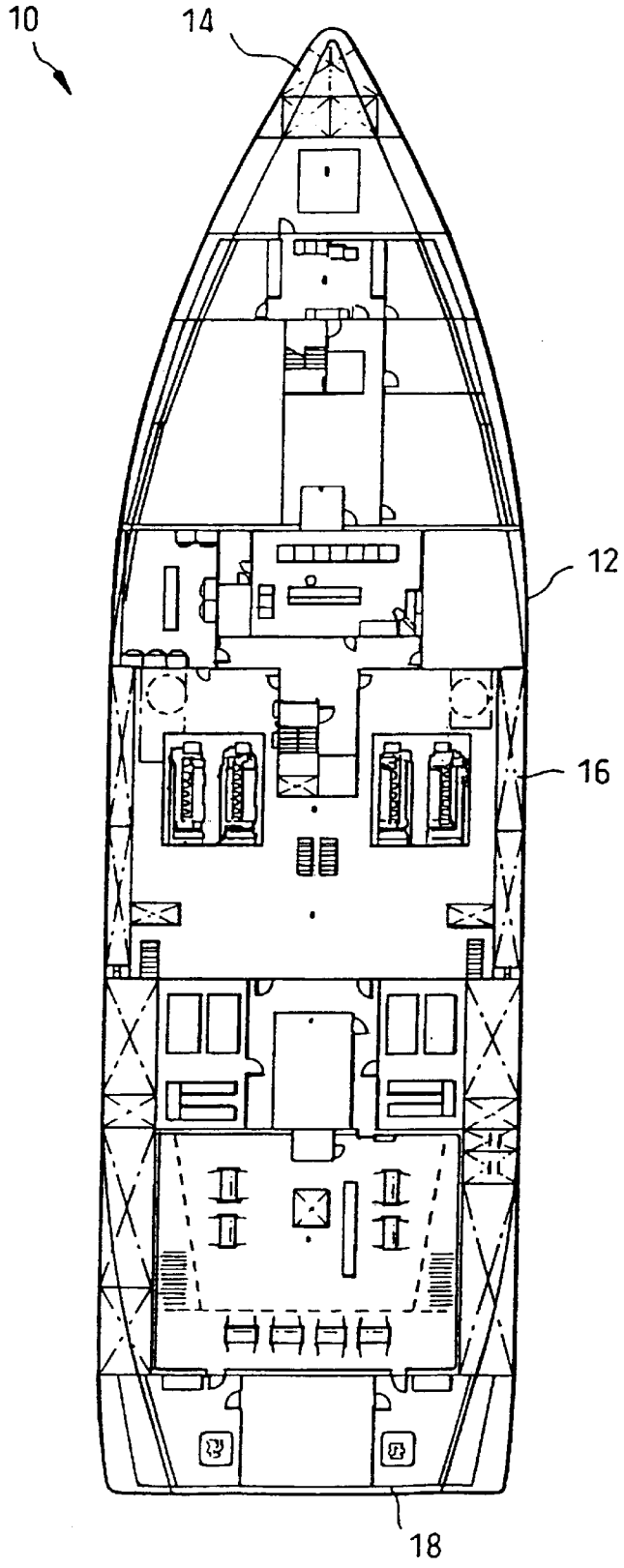
FIG. 1 is a plan view of a deep marine seismic survey vessel in accordance with the present invention, substantially at the level of its waterline.

The deep marine seismic survey vessel shown in the drawings is indicated generally at 10, and has a displacement monohull 12 which is typically just over 80 meters long at the waterline (and just under 90 meters long overall), with a beam of about 24 meters. The maximum displacement of the vessel 10 is typically about 7500 tonnes.

As can be seen in FIG. 1, the shape of the hull 12 at the waterline is fairly conventional, in that the width of the hull increases smoothly and progressively from the bow 14 to a centre section 16 of substantially uniform width, and then progressively decreases, but to a much lesser extent, from the centre section to a wide cut-off stern 18. Below the waterline, the taper towards the stern 18 increases progressively with depth.

The vessel 10 has most if not all of the major features common to a vessel of its type and size, eg multiple diesel engines, bow thrusters, electric generators, accommodation for 60 to 70 persons, a helideck, winches/derricks, emergency equipment, etc. However, since these features can take any of several well known and conventional forms, and are not germane to the present invention, they will not be described in detail for the sake of simplicity.

Additionally, the vessel 10 is arranged in accordance with the invention for performing deep marine seismic surveys, as will now be described.

Figure 2:
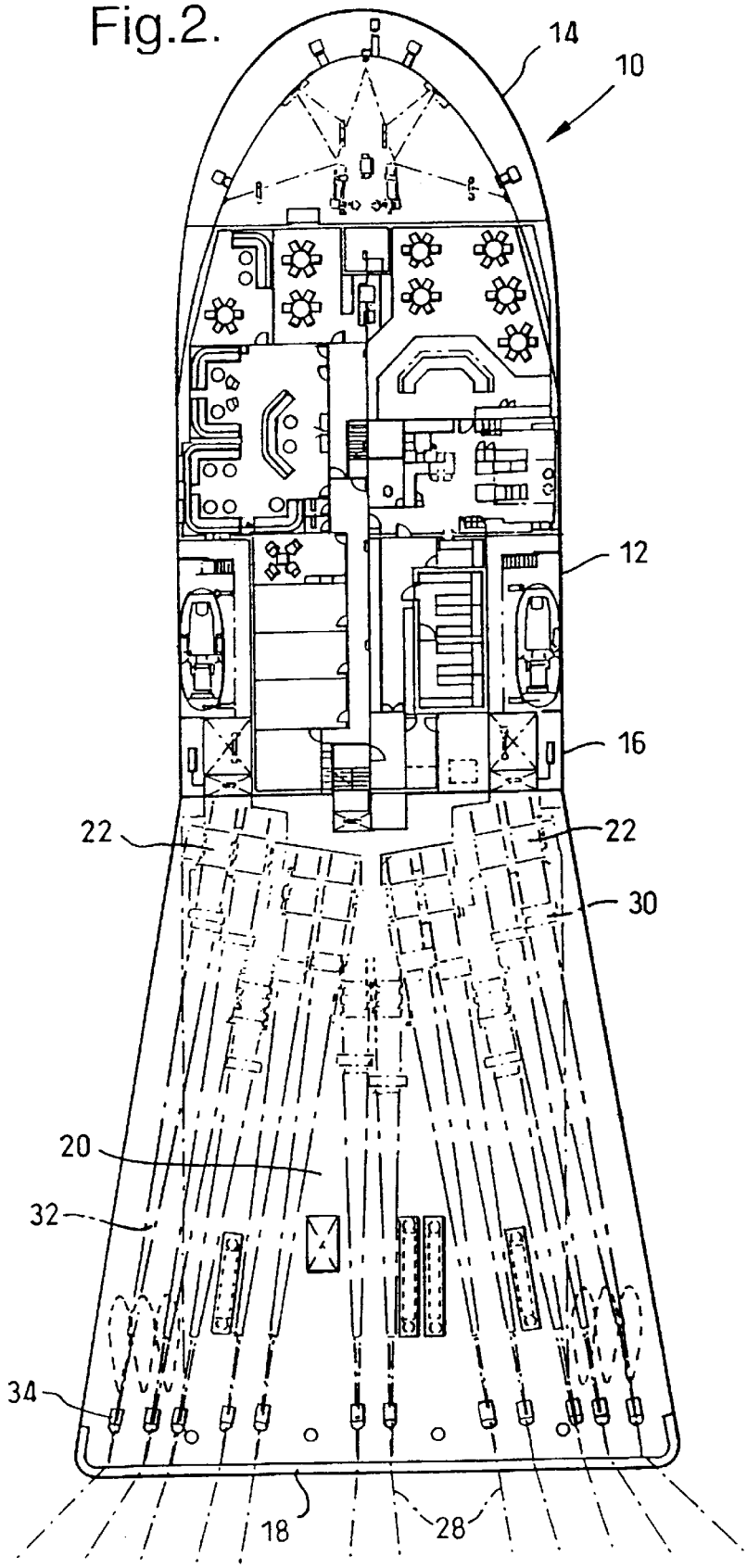
FIG. 2 is a plan view of the streamer deck of the vessel of FIG. 1.
Figure 3:
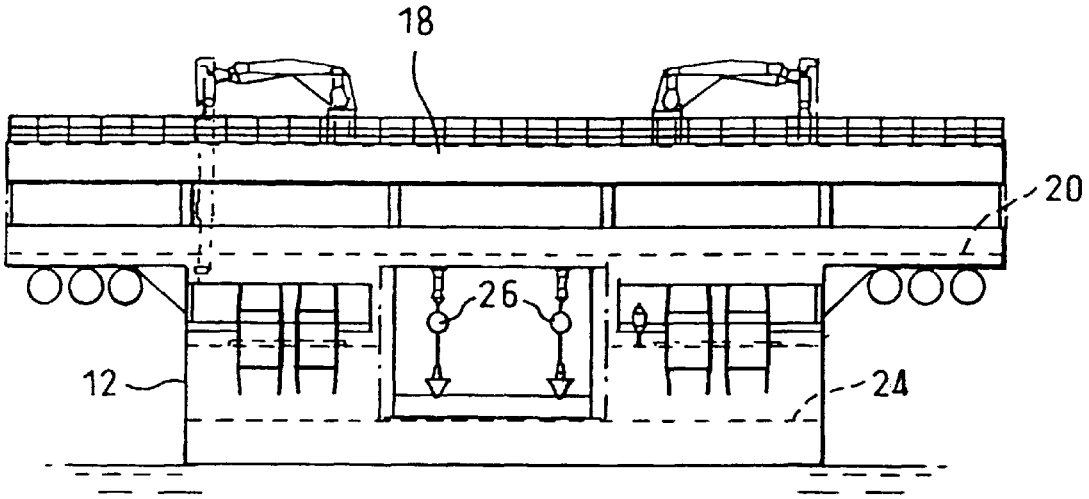
FIG. 3 is a stern view of the vessel of FIGS. 1 and 2.

Thus as can be seen in FIG. 2, the vessel 10 has a streamer deck 20 which extends aft from the centre section 16, increasing linearly in width as it does so from about 24 meters at the centre section to about 37.5 meters at the stern 18, the increase in width taking place symmetrically on each side of the fore-and-aft centre line of the vessel 10. The overall length of the streamer deck is about 36 meters, while the height of the streamer deck 20 above the waterline of the vessel 10 is typically about 9 meters.

Within the centre section 16 of the vessel 10, sixteen large powered streamer drums 22 are distributed across the width of the vessel, each drum having its axis extending substantially horizontally and transversely of the vessel 10 and being capable of storing a respective streamer up to 6000 meters long, together with its lead-in. The outer four drums 22 on each side of the centre line of the vessel 10 are mounted at least partly below the streamer deck 20, while the inner eight drums are mounted on the streamer deck itself, the drums being partly interleaved to fit them in the available space. The lower drums 22 overspool, while the upper ones underspool.

At the centre of the stern 18 of the vessel 10, beneath the streamer deck 20, is a deck 24 known as the gun deck. From the gun deck 24, seismic sources 26, typically multiple airgun seismic sources of the kind described in the Applicant's U.S. Pat. No. 4,686,660, are deployed, typically using a handling system of the kind described in Applicant's U.S. Pat. No. 5,488,920.

In use, the streamers, indicated rather diagrammatically at 28, each pass over a respective guide 30 and then along the length of the streamer deck towards the stern 18 of the vessel 10. As they pass over the streamer deck 20, the streamers 28 pass via respective tension relieving devices 32, and at the stern 28 they each pass over a respective further guide, this time in the form of a spooling block 34 with its axis extending substantially vertically. To save space, the spooling blocks 34 can be of the type described and claimed in the Applicant's PCT Patent Application No PCT/IB97/00156 (WO 97/29302). Each spooling block 34 forms part of a respective streamer handling apparatus, which will be described in more detail hereinafter with reference to FIGS. 4 to 6.

Once deployed over the stern 18 of vessel 10, the twelve streamers 28, towed at about 5 knots by the vessel, are formed into an array typically up to 1100 meters wide, using Applicant's MONOWING deflectors as described hereinbefore. This wide streamer array is then used, in conjunction with the seismic sources 26, to perform a 3D marine seismic survey as described earlier.

The vessel 10 has a number of advantages over prior art seismic survey vessels of comparable size. For example, the fact that the vessel 10 has a substantially conventional displacement monohull means that it is not much more expensive to build than the prior art vessels. Further, the powered drums 22 with the streamers 28 wound on them are extremely heavy, so their location amidships, as low as conveniently possible, contributes to the stability and seaworthiness of the vessel 10.

Another major advantage of the vessel 10 lies in the substantially increased width of the streamer deck 20 at the stern 18 of the vessel. This facilitates the formation of the extra wide streamer array, inter alia by reducing the angles through which the lead-ins of the outer streamers 32 in particular are required to bend at the stern of the vessel to form the array. This latter feature reduces the stresses to which the lead-ins and the streamers 32 are subjected, so reducing the possibility of breakage. The increased width also provides more space at the stern 18 for working with the increased number of streamers 28 used to form the extra wide array. But because the streamer deck 20 is 9 meters above the waterline of the vessel 10, it does not significantly interfere with the docking of the vessel, since the deck will normally be well above the dock and will therefore merely project over it.

Figure 4:
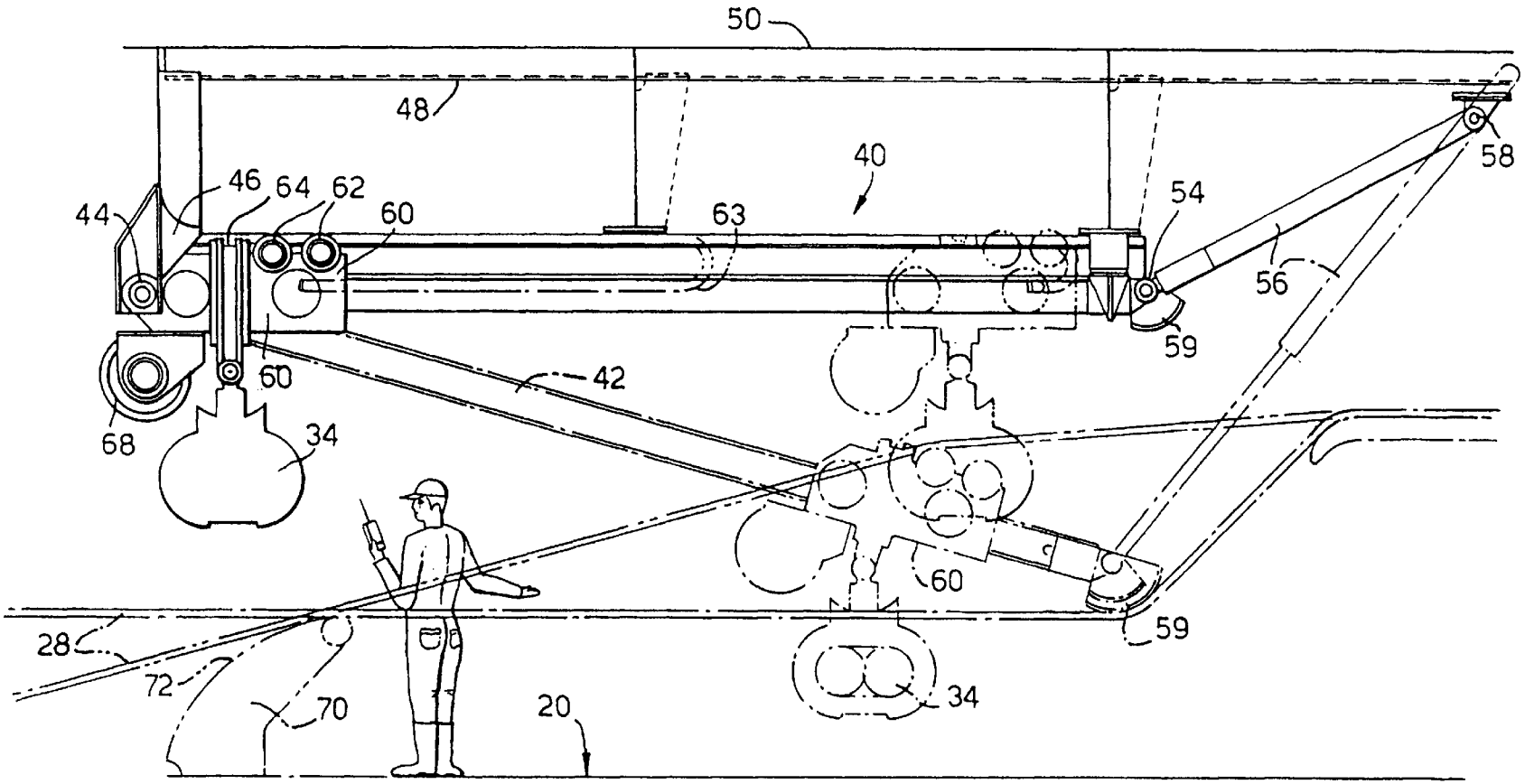
FIG. 4 is a side view of streamer handling apparatus incorporated in the vessel of FIGS. 1 to 3.
Figure 5:
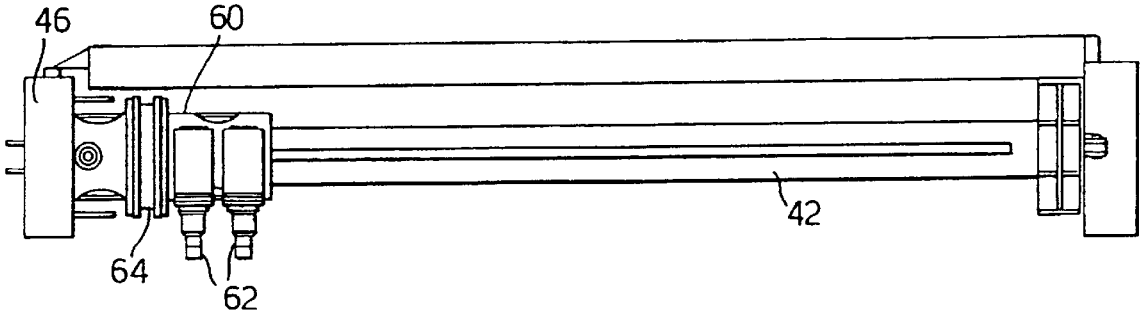
FIGS. 5 and 6 are top and end views respectively of the streamer handling apparatus of FIG. 4.
Figure 6:
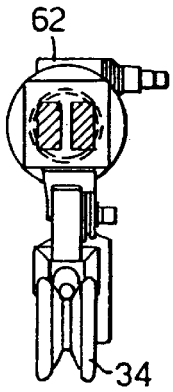

The extra space across the width of the streamer deck 20 at the stern 18 of the vessel 10 also creates sufficient room for the installation of new and improved streamer handling apparatus, one for each streamer: this new and improved streamer handling apparatus is shown in FIGS. 4 to 6.

The streamer handling apparatus of FIGS. 4 to 6 is indicated generally at 40, and comprises an elongate beam 42 which extends generally longitudinally of the vessel 10. The beam 42 is pivotally mounted at its end 44 nearer the stern 18 of the vessel to mounting structure 46, which is firmly secured to the underside 48 of the deck 50 of the vessel immediately above the streamer deck 20: the deck 50 is, in fact, the upper stern deck of the vessel.

The beams 42 of adjacent streamer handling apparatuses 40 diverge slightly, or fan out, towards the stern 18 of the vessel, to follow the increasing width of the stern.

As will become apparent hereinafter, the beam 42 normally extends parallel to the streamer deck 20 and the upper deck 50, ie substantially horizontally, at a height of nearly 4 meters above the former. To this end, the other end 52 of the beam 42 is pivotally connected to one end 54 of a hydraulically operated extendable telescopic arm 56, whose other end 58 is pivotally connected to the underside 48 of the upper deck 50. In its unextended state, the telescopic arm 56 securely holds the beam in its normal, horizontal, position, while extension of the telescopic arm 56 lowers the end 52 of the beam 42 to a height of about 1 meter above the streamer deck 20, ie to about waist height. Both the raised and lowered positions of the beam 42 are shown in FIG. 4

A curved guide 59, effectively a 90° segment of a pulley wheel, is pivotally secured to the joined ends 52, 54 of the beam 42 and the telescopic arm 56 respectively.

Mounted on the beam 42 so as to be movable in both directions along it is a carriage 60. Motive power for the carriage 60 is provided by hydraulic motors 62, which typically move the carriage, on suitably positioned wheels (not shown), along the beam via a rack and pinion drive arrangement (not shown). Pressurised hydraulic fluid for the motors 62 is supplied via a long flexible pressure hose 63, which unfolds as the carriage 60 moves along the beam 42.

The carriage 60 rotatably supports a collar 64, which coaxially surrounds both the carriage and the beam 42 and is rotatable about the longitudinal axis of the beam. The collar 64 supports in turn the spooling block 34, which is effectively a particularly compact equivalent of a large radius pulley or fairlead. The spooling block 34 is pivotally suspended beneath the collar 64, so as to pivot about an axis extending generally transversely of the beam 42.

The end 66 of the carriage 60 nearer the stern end 44 of the beam 42 is provided with a winch 68.

In normal use, ie when the streamer 28 handled by the apparatus 40 is deployed and being towed, the beam 42 is held in its raised horizontal position, and the carriage 60 is locked at the stern end 44 of the beam. The streamer 28 passes over the spooling block 34, which is free by virtue of the ability of the collar 64 to rotate about the carriage 60 and the pivotal connection between the spooling block and the rotatable collar 64 to pivot both sideways and fore and aft, to accommodate lateral and vertical changes of direction of the streamer as it leaves the stern 18 of the vessel 10.

When it is desired to work on the streamer 28, eg to connect or remove a depth controlling "bird" or other device to it during deployment or recovery, the carriage 60 is moved towards the other end 52 of the beam 42 by the motors 62, and the telescopic arm 56 is extended, thus lowering the end 52 of the beam towards the streamer deck 22. As the end 52 of the beam 42 is lowered, the curved guide 59 engages the streamer 28, and pushes it down towards the streamer deck 22 until it reaches about the same level as the top of stern rail 70 of the streamer deck. The stern rail 70 extends substantially the whole width of the streamer deck 22, and is formed with a rearwardly-facing curved surface 72 which supports the lowered streamer 28. The surface 72, as well as each of the other curved surfaces which engage or are engaged by the streamers 28, is of sufficiently large radius to ensure that the minimum bending radius of the streamer is not exceeded.

Before or after the streamer 28 is fully lowered, the winch 68 can be coupled to a suitable attachment point on it, and then reeled in a little to take the strain off the portion of the streamer on the vessel, ie to the right of the attachment point to the hoist, as viewed in FIG. 4. Then, once the streamer 28 is fully lowered and no longer under tension, it is very easy to work on, being typically at waist height above the streamer deck 22. If desired, a bench or the like can be provided in the working area on the streamer deck 22, to make such work even easier.

The winch 68 is also used to raise and bring onto the streamer deck 22 auxiliary equipment associated with the streamer 28, eg tailbuoys, acoustic positioning equipment and the like.

The streamer handling apparatus 40 is thus particularly ergonomically advantageous. In its normal (or towing) condition, it is mostly disposed above head height above the streamer deck 22, leaving the deck relatively clear for personnel to move about. But in its lowered condition, it provides particularly good access to the streamer 28 passing through it.

Many modifications can be made to the streamer handling apparatus 40. For example, the hydraulic motors 62 can be replaced by electric motors, while the telescopic arm 56 can be replaced by any other support device capable of moving the end 52 of the beam 42 up and down between its raised and lowered positions. And the spooling blocks 34 can be replaced by any other suitable fairlead or pulley device.

Additionally, if there is no upper deck above the streamer deck 22, the mounting means for mounting the beam 42 above the streamer deck can comprise a suitably shaped frame supported on the streamer deck itself.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A seismic survey vessel having a stern, comprising:

a displacement monohull;

a streamer deck;

powered drum apparatus and cooperating guide apparatus adapted for deploying and recovering seismic streamers over said stern of said vessel via said streamer deck, said powered drum apparatus being mounted substantially amidships in said vessel, said streamer deck at said stern of said vessel projecting laterally outwardly from the monohull of said vessel on both sides of a center line of the vessel and being wider than the remainder of said vessel, said cooperating guide apparatus including one or more guide devices distributed across substantially the whole width of said streamer deck for facilitating a lateral spreading of the seismic streamers.

2. The seismic survey vessel of claim 1, wherein said streamer deck of said vessel is an upper deck at a particular height, said particular height being chosen such that, when the vessel is docked at a dock, the deck of said vessel is above said dock.

3. The seismic survey vessel of claim 1, wherein a width of said streamer deck decreases progressively from the stern of said vessel until said width is substantially equal to a width of said vessel amidships.

4. The seismic survey vessel of claim 1 wherein at least a part of said powered drum apparatus is mounted in said vessel at a level which is lower than the level of said streamer deck.

5. The seismic survey vessel of claim 1, further comprising:

a further deck below said streamer deck at said stern of said vessel, said further deck including means for deploying and recovering seismic sources over the stern of said vessel.

6. The seismic survey vessel of claim 1, wherein each of said one or more guide devices comprises a streamer handling apparatus which is associated with one of said seismic streamers, said streamer handling apparatus comprising:

a beam;

means for mounting said beam above normal head height above the streamer deck of said vessel such that the beam extends generally longitudinally of the vessel, said means for mounting including a pivotal connection to the sternmost end of said beam permitting said end to pivot about a horizontal axis extending generally transversely of the beam;

extendable support means for lowering and raising the other end of the beam towards and away from the streamer deck; and a respective one of said guide devices, each said guide device including a pulley apparatus secured to and movable along the beam.

7. The seismic survey vessel of claim 6, wherein said pulley apparatus includes a pulley device which is pivotable about an axis that extends generally transversely of the beam.

8. The seismic survey vessel of claim 6, wherein said pulley apparatus comprises a carriage apparatus movable along said beam, a pulley device, and means for suspending the pulley device beneath said carriage apparatus.

9. The seismic survey vessel of claim 8, wherein said means for suspending comprises a collar which is rotatably supported on the carriage apparatus and which is rotatable about a longitudinal axis of said beam.

10. The seismic survey vessel of claim 9 wherein said carriage apparatus includes at least one hydraulic motor arranged to move the carriage apparatus in both directions along said beam.

11. The seismic survey vessel of claim 10, wherein the sternmost end of said carriage apparatus includes a winch apparatus.

12. The seismic survey vessel of claim 11, wherein said pulley apparatus includes a pulley device which is pivotable about a horizontal axis that extends generally transversely of the beam.

13. The seismic survey vessel of claim 6 wherein said extendable support means comprises a telescopic member which is pivotally connected at one end to said means for mounting and at the other end to said other end of the beam.

14. The seismic survey vessel of claim 13, wherein said extendable support means is hydraulically operable.

15. The seismic survey vessel of claim 6, further comprising:

a downwardly projecting guidance apparatus which is positioned at said other end of said beam and which engages and pushes down said streamer when said other end of the beam is lowered.

16. The seismic survey vessel of claim 6, wherein said vessel includes a further deck above said streamer deck, said means for mounting being secured to an underside of said further deck.

17. A seismic survey vessel having a stern, comprising:

a displacement monohull;

one or more powered drums;

a streamer deck located adjacent said stern of said vessel; and one or more corresponding cooperating guides adapted for deploying and recovering a corresponding one or more seismic streamers via said streamer deck over said stern of said vessel, said one or more powered drums being distributed across the width of said vessel, said streamer deck at said stern of said vessel projecting laterally outwardly from the monohull of said vessel on both sides of a center line of the vessel and being wider than the remainder of said vessel, said one or more guides including one or more corresponding guide devices distributed across substantially the whole width of said streamer deck for facilitating a lateral spreading of the seismic streamers, said streamer deck of said vessel being an upper deck at a particular height, said particular height being chosen such that, when the vessel is docked at a dock, the deck of said vessel is above said dock, a width of said streamer deck decreasing progressively from the stern of said vessel until said width is substantially equal to a width of said vessel amidships.

18. A seismic survey vessel having a stern, comprising:

a displacement monohull;

a streamer deck, said streamer deck at said stern of said vessel projecting laterally outwardly from the monohull of said vessel on both sides of a center line of the vessel and being wider than the remainder of said vessel;

one or more powered drums, said one or more powered drums being distributed across a width of said vessel, at least a part of said one or more powered drums being mounted in said vessel at a level which is lower than the level of said streamer deck;

a further deck below said streamer deck at said stern of said vessel, said further deck including means for deploying and recovering seismic sources over the stern of said vessel; and one or more corresponding cooperating guides on said streamer deck adapted for deploying and recovering a corresponding one or more seismic streamers via said streamer deck over said stern of said vessel, said one or more guides including one or more corresponding guide devices distributed across substantially the whole width of said streamer deck for facilitating a lateral spreading of the seismic streamers.

* * * * *